United States Patent [19]

Blum

[11] Patent Number: 4,590,450

[45] Date of Patent: May 20, 1986

[54] ELECTROMAGNETIC SWITCH APPARATUS

[75] Inventor: Alex Blum, Unterentfelden, Switzerland

[73] Assignee: Sprecher & Schuh AG, Aarau, Switzerland

[21] Appl. No.: 672,111

[22] Filed: Nov. 15, 1984

[30] Foreign Application Priority Data

Nov. 28, 1983 [CH] Switzerland ..... 6340/83

[51] Int. Cl.[4] ..... H01H 51/08

[52] U.S. Cl. ..... 335/129; 335/135; 335/202

[58] Field of Search ..... 335/128, 135, 129, 131, 335/132, 133, 202, 159, 160, 161, 197, 198, 126

[56] References Cited

U.S. PATENT DOCUMENTS 2,523,774 9/1950 Moran ..... 335/129
2,672,536 3/1954 Rosing et al. ..... 335/129
3,243,564 3/1966 Burch ..... 335/132
4,443,675 4/1984 Drexler et al. ..... 335/135

FOREIGN PATENT DOCUMENTS 2143488 7/1974 Netherlands .

*Primary Examiner*—Harold Broome
*Attorney, Agent, or Firm*—Ladas & Parry

[57] ABSTRACT

The electromagnetic switch apparatus is housed in a two-partite casing. A partition wall inserted into the casing separates the switching magnet chamber from the switch- and connection contact chamber. The partition wall comprises a plurality of extensions which are stepped at least twice and extend into the switch- and connection contact chamber. The portions of the extensions located below the connection contact members cover in an electrically insulating manner the lower areas of the switch- and connection contact members. The upper narrow portions of the extensions extend up to in front of the connection contact members and form a protection against an accidental contact.

4 Claims, 5 Drawing Figures

ELECTROMAGNETIC SWITCH APPARATUS

BACKGROUND OF THE INVENTION

1. Field of the Invention

The present invention relates to an electromagnetic switch apparatus including a two-partite casing and a partition wall inserted therein, which divides the casing into a switching magnet chamber and a connection contact chamber, and including a coupling lever arranged between a movable armature of the switching magnet in the switching magnet chamber and a contact bridge carrier in the switch- and connection contact chamber.

2. Description of the Prior Art

An electromagnetic switch apparatus of the kind set forth above is disclosed in the German published patent application No. DE-AS 21 43 488. The apparatus disclosed comprises plug-in type contact pins projecting from the casing half which closes the contact chamber off. Such switch apparatus has application only in connection with plug-in type connections.

A further electromagnetic switch apparatus including a switching magnet block and a switch- and connection contact block is disclosed in the U.S. Pat. No. 3,243,564. The two blocks are designed such that they may be assembled together. Such design necessitates, however, a separate casing for each block. Moreover, the switch apparatus is provided with connecting screws for connecting cables. The connecting contact members of the apparatus are not covered for protection against an accidental contact.

SUMMARY OF THE INVENTION

An object of the present invention is to provide an electromagnetic switch apparatus for wire connections including a protection against an accidental contact of the connection contact pieces, which is extremely economical in manufacturing, simple in construction and design, reliable in operation and dependable in use.

A further object is to provide an electromagnetic switch apparatus having a dividing wall comprising a plurality of at least twice stepped extensions projecting into the switch- and connection contact chamber, the broader portions of the extensions located at a smaller distance from the partition wall covering the lower areas of the switch- and connection contact members inserted into the casing, and the upper narrower portions of the extensions projecting in front of the connection contact members and forming a protection against an accidental contact.

Preferably, the extensions comprise detents which engage behind edges arranged in the casing and hold the partition wall in the casing.

The connection contact pieces are preferably provided with connection screws and the narrow portions of the extensions are preferably narrower than the diameter of the connection screws. The narrow portions of the extensions when viewed from the connection side of the connecting apparatus are preferably aligned towards the center of the connection screws.

BRIEF DESCRIPTION OF THE DRAWINGS

The present invention will be more fully understood by reference to the following detailed description thereof when read in conjunction with the attached drawings, and wherein.

DESCRIPTION OF THE PREFERRED EMBODIMENT

Figure 1:
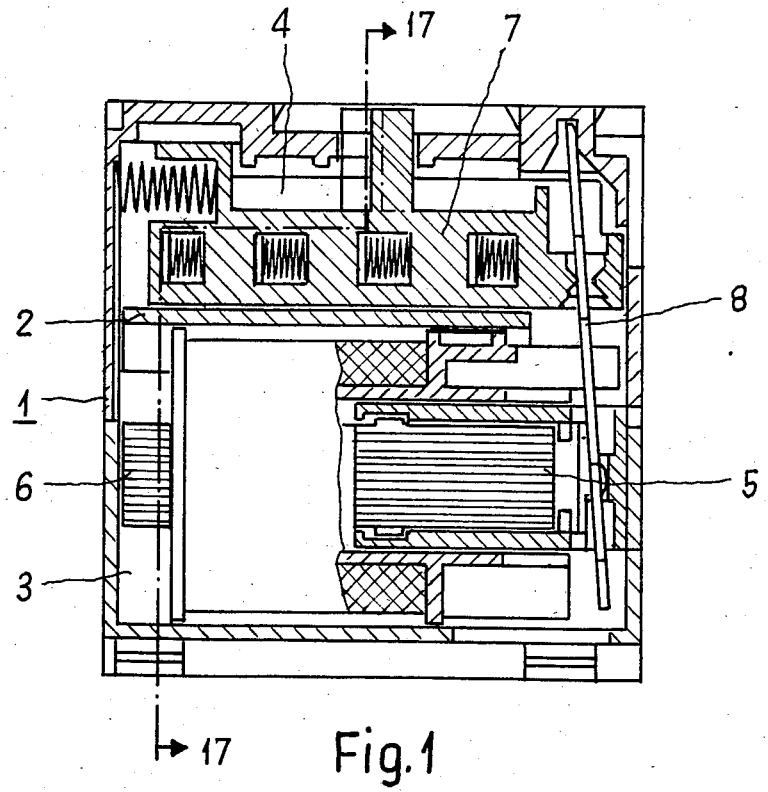
FIG. 1 illustrates a view of a longitudinal section of an electromagnetic switch apparatus.

The electromagnetic switch apparatus, of which FIG. 1 illustrates a longitudinal section, is housed in a two-partite casing 1. The partition wall 2 inserted therein divides the switching magnet chamber 3 from the switch- and connection contact chamber 4. The movable armature 5 of the switching magnet 6 operates upon excitation of the switching magnet via the coupling lever 8 supported in casing 1 the contact switch carrier 7. The partition wall 2 comprises a plurality twice stepped extensions 9 which project into the switch- and connection contact chamber, which extensions 9 are most clearly to be seen in FIGS. 2 and 4. FIG. 3 illustrates that the broader portions 10 of the extensions 9 which are located closer to the partition wall cover the areas of the switch and connection contact members located below the connection contact members 11. The switch- and connection contact members 12 are pressed into recesses provided in casing 1 and which are not particularly illustrated. The broader portions 10 of the extensions 9 encase these contact members 12 and provide at the same time an electrically insulating covering.

Figure 5:
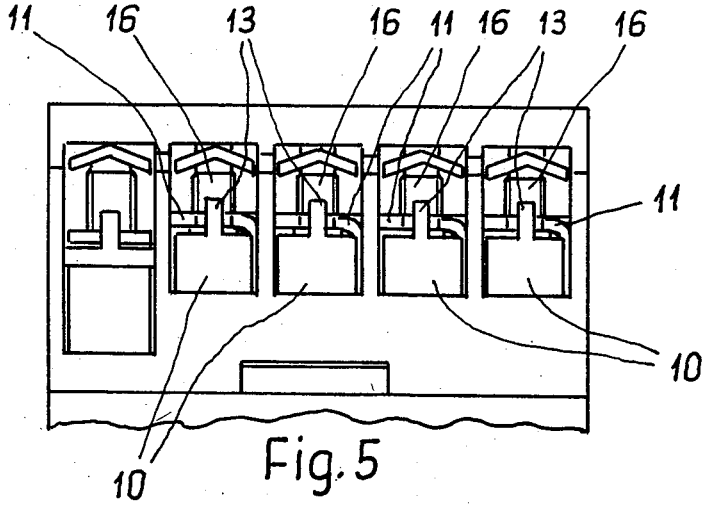
FIG. 5 is a side view of a part of the switch apparatus.

The upper narrow portions 13 of the extensions 9 extend up to the area of the connection contact members 11 and provide a protection against an accidental contact with the live metal parts. FIG. 5 illustrates merely the upper part of the switch apparatus, whereby the narrow portions 13 of the extensions 9 projecting into the area of the connection contact members 11 are clearly viewable.

Figure 2:
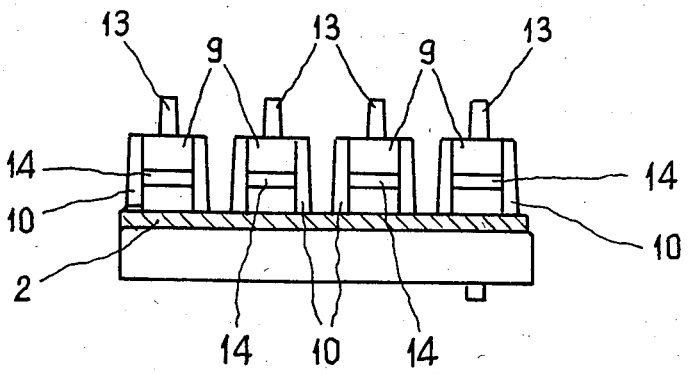
FIG. 2 illustrates a partition wall in section.
Figure 3:
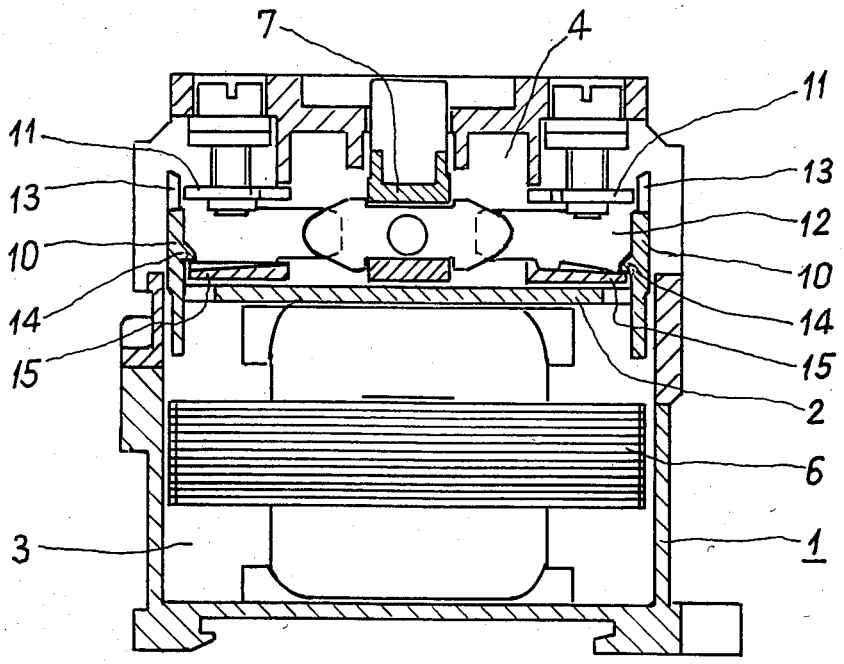
FIG. 3 is a view of a section of the switch apparatus along line 17—17 of FIG. 1.
Figure 4:
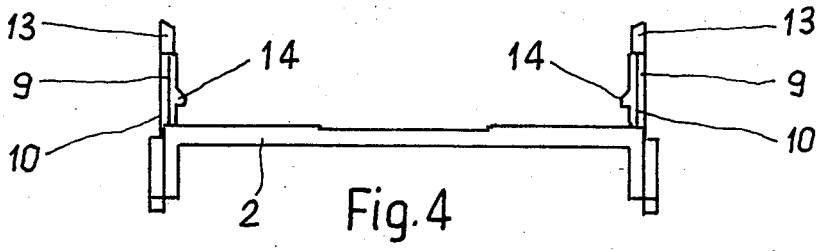
FIG. 4 illustrates a laterally disposed partition wall.

As can be clearly seen from FIGS. 2, 3 and 4 the extensions 9 are formed to have detents 14 which grip behind edges 15 of the casing 1. Due to this feature the partition wall 2 is safely held in the casing 1 following the simple assembling thereof.

The narrow portions 13 of the extensions 9 are preferably narrower than the diameter of the connection screws 16. Accordingly, the wires which are to be connected to the apparatus can be quite easily pushed to the connection screws 16. The upper narrow portions 13 of the extensions 9 are, according to FIG. 5 when viewed from the connection side of the connecting apparatus, aligned towards the center of the connection screws. The narrow portion of the extension 9 can be stepped towards one side allowing a one-sided connecting possibility at the side of the connection screw 16.

While there is shown and described the present preferred embodiment of the invention, it is to be distinctly understood that the invention is not limited thereto, but may be otherwise variously embodied and practiced within the scope of the following claims.

I claim:

1. An electromagnetic switch apparatus including a two-partite casing and a partition wall inserted therein, which divides the casing into a switching magnet chamber and a connection contact chamber, and including a coupling lever arranged between a movable armature of the switching magnet in the switching magnet chamber and a contact bridge carrier in the switch- and connection contact chamber, in which said partition wall comprises a plurality of at least twice stepped extensions projecting into the swtich- and connection contact chamber, the broader portions of the extensions located at a smaller distance from the partition wall covering the lower areas of the switch- and connection contact members inserted into the casing, and the upper narrower portions of the extensions projecting in front of the connection contact members and forming a protection against an accidental contact.

2. The electromagnetic switch apparatus of claim 1, in which the extensions comprise detents which engage behind edges arranged in the casing and hold the partition wall in the casing.

3. The electromagnetic switch apparatus of claim 1 including connection screws, in which the narrow portions of the extensions are narrower than the diameter of the connection screws.

4. The electromagnetic switch apparatus of claim 3, in which the narrow portions of the extensions when viewed from the connection side of the connecting apparatus are aligned towards the center of the connection screws.

* * * * *